US005197197A

United States Patent [19]

Himmighofen et al.

[11] Patent Number: 5,197,197

[45] Date of Patent: Mar. 30, 1993

[54] HAND-HELD SQUEEZE LEVER OR PINCER-TYPE CAN OPENER

[75] Inventors: Dieter Himmighofen, Roth; Rolf G. Schülein, Singhofen, both of Fed. Rep. of Germany

[73] Assignee: Leifheit AG, Nassau/Lahn, Fed. Rep. of Germany

[21] Appl. No.: 835,205

[22] Filed: Feb. 13, 1992

[30] Foreign Application Priority Data

Feb. 19, 1991 [DE] Fed. Rep. of Germany ..... 4105022

[51] Int. Cl.[5] ..... B67B 7/32; B67B 7/10; B26B 13/100; B26B 13/20

[52] U.S. Cl. ..... 30/416; 30/260; 30/426

[58] Field of Search ..... 30/416, 417, 418, 426, 30/431, 260, 254

[56] References Cited

U.S. PATENT DOCUMENTS

| | | | |
|---|---|---|---|
| 2,481,609 | 9/1949 | McLean | 30/416 |
| 3,906,630 | 9/1975 | Megna | 30/260 |
| 4,150,484 | 4/1979 | Hildebrandt | 30/254 |
| 4,563,818 | 1/1986 | Kreth et al. | 30/417 |
| 4,574,482 | 3/1986 | van der Wouden | 30/426 |
| 4,754,550 | 7/1988 | Koo | 30/417 |

FOREIGN PATENT DOCUMENTS

| | | |
|---|---|---|
| 539475 | 9/1984 | Australia . |
| 2802172 | 7/1979 | Fed. Rep. of Germany . |
| 2843442 | 4/1980 | Fed. Rep. of Germany . |
| 2012653 | 8/1979 | United Kingdom . |
| 2033869 | 5/1980 | United Kingdom . |

*Primary Examiner*—Douglas D. Watts
*Assistant Examiner*—Paul M. Heyrana, Sr.
*Attorney, Agent, or Firm*—Frishauf, Holtz, Goodman & Woodward

[57] ABSTRACT

To facilitate manufacture and eliminate the possibility of sharp corners projecting from metallic elements of a can opener, a bearing bushing (21) for a feed wheel shaft (20), to which a serrated feed wheel (15) and a twist knob (16) are connected, the handle is formed of two plastic handle shells (18, 19) of which an upper handle shell (18) is a unitary molded element together with the bearing bushing (21) and a counter or guide surface (24) in part surrounding the feed wheel. The bearing bushing extends through a hole in the metallic lever (11, 12) and into an opening of the lower handle shell (19), preferably forming a snap connection, with a slightly projecting shoulder, extending above the lower handle shell.

10 Claims, 6 Drawing Sheets

HAND-HELD SQUEEZE LEVER OR PINCER-TYPE CAN OPENER

FIELD OF THE INVENTION

The present invention relates to a hand-held can opener, in which two squeeze levers or pincers have lever handles which are pivotably connected, and carry a can opener mechanism close to the pivot of the lever, and more particularly to such a construction which is sturdy, safe and readily made.

BACKGROUND

Hand-held squeeze lever can openers are known, and described, for example, in the referenced German Patents 28 02 172, SchHlein et al, and 28 43 442, Liebscher et al.

Can openers of this type customarily have two metal handles, pivotably connected, one of which carries a feed wheel having a toothed or serrated circumference, and the other carrying a cutter wheel. The shaft which carries the feed wheel is extended from one side of the usually essentially flat handle or lever to the other side, where an operating knob is placed on the shaft, so that the feed wheel can be rotated. Gears mounted on the shaft and on the retaining shaft for the cutter wheel can be brought into engagement when the levers are squeezed together, against the rim of a can, so that upon rotation of the feed wheel by a twist knob, the cutter, likewise, will rotate, cutting into the lid of a can pinched between the cutter wheel and a counter surface, if provided.

This construction, which works very well, in the past required retention of a bearing bushing for the feed wheel by a metal part deformed or punched out from the usually metallic handle. The bearing bushing. typically, is of plastic material. Such a construction requires particularly high-quality steel for the handle, which can be deep-drawn. Yet, the danger always occurs that the edge of a collar formed on the handle, to retain the bearing bushing, will tear and sharp corners or edges will form. It has also been found that, in use, plastic or other handle shells covering the metal portion of the handle can become loose. These handle covers were matched to the shape of the metal levers and thus constrained the appearance design of the overall can opener to the shape of the metal handle.

THE INVENTION,

It is an object to improve a hand-held squeeze lever or pincer-type can opener of the well-known type, in which the handles can be formed as composite elements which can be varied in shape, in accordance with desired appearance design and which, at the same time, ensures reliable support of a shaft for the rotatable feed wheel and the twist knob therefore, without, however, requiring particular high-quality steel for the metallic portion of the can opener.

Briefly, two handle shells are provided, fitted against each other with a generally flat metal lever element therebetween. These two shells form, respectively, an upper handle shell and a lower handle shell, and they are formed with interlocking, interengaging projecting-and-recess means, passing through suitable openings in the metal handle so that they are reliably retained thereon. The bearing bushing and a counter element, if provided, forms a single unitary cast or molded body which, further, is unitary with one of the molded handle shells, and extended to fit into a matching opening in the other handle shell, passing through the respective metal feed arm.

Forming the covers for the metal lever handles in two parts, namely in two handle shell portions, one of which has the bearing bushing directly molded thereon which, in turn, is retained on the other, or second handle shell, provides for highly stable support of the shaft for the feed wheel and the twist knob to operate the same. The handle shells themselves, in the entire handle region remote from the operating mechanism, can be shaped in accordance with any desired appearance design, in any desired colors or color combinations, so that the industrial designer has wide leeway for optimum design configuration. Mechanically, however, they are reliably retained on the metal levers which support the operating mechanism.

In accordance with a feature of the invention, the handle shells are formed, respectively, with projecting hollow stubs, passing through suitable holes in the metal handle, into which pins formed on the other handle shell fit. Additionally, or alternatively, the handle shells are formed with resiliently deflectable snap-in hooks, engaging into the metal handle lever, which reliably prevents axial slippage or shift, or loosening of the respective handle shells.

The arrangement has the additional advantage that the handle shells can be formed, integrally, at their ends remote from the pivot point with projecting eyes facing each other, in which the eyes are slightly centrally offset from each other so that, when the can opener levers are closed, they overlap each other. This permits safe and easy storage of the can opener, for example by hanging it on a hook. The eyes, also, provide for a minimum spacing of the handle levers from each other when they are closed, and thus prevent pinching of the hand of a user when the levers are closed against each other upon operation of the can opener.

DRAWINGS

FIG. 14 is a section along line XIV—XIV of FIG. 2.

DETAILED DESCRIPTION.

Figure 1:
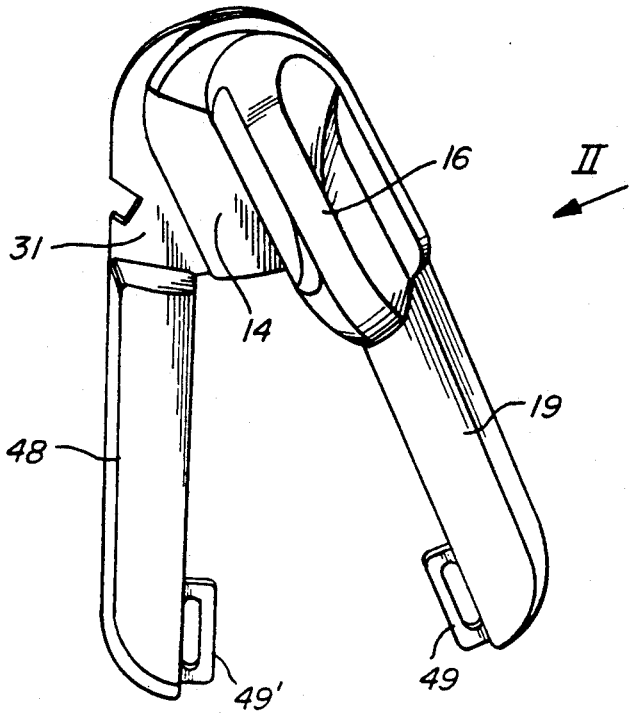
FIG. 1 is a general top view of the can opener, slightly opened.
Figure 2:
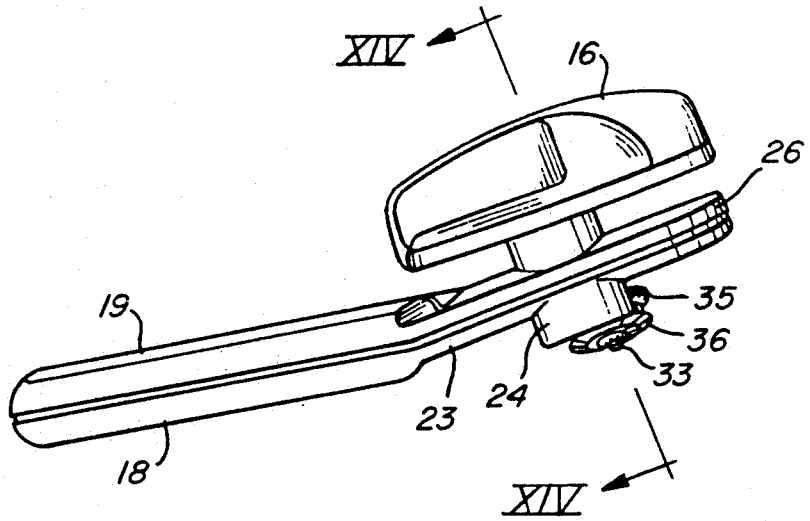
FIG. 2 is a side view of the can opener of FIG. 1, looking from the side of the arrow II of FIG. 1.
Figure 3:
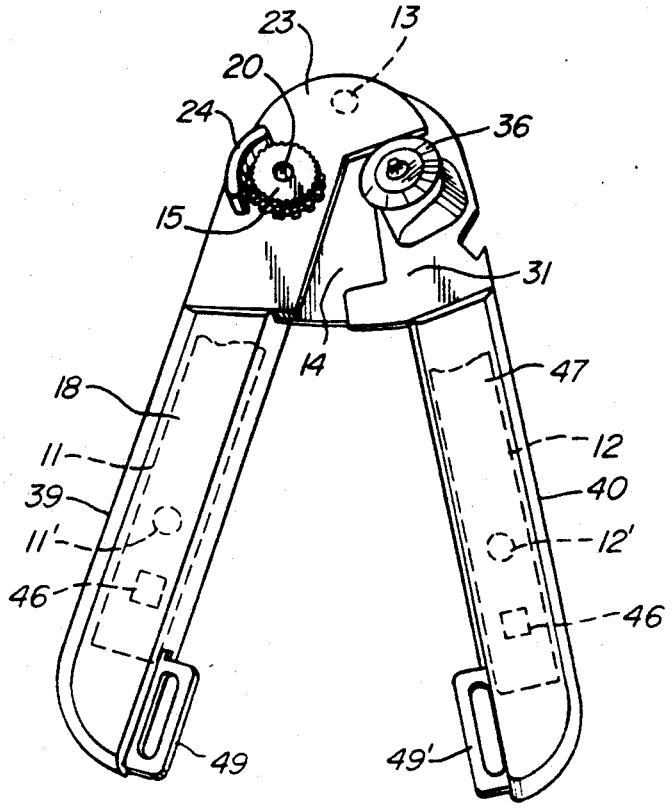
FIG. 3 is a back view, and showing, in broken lines, the extent of the metal lever.
Figure 4:
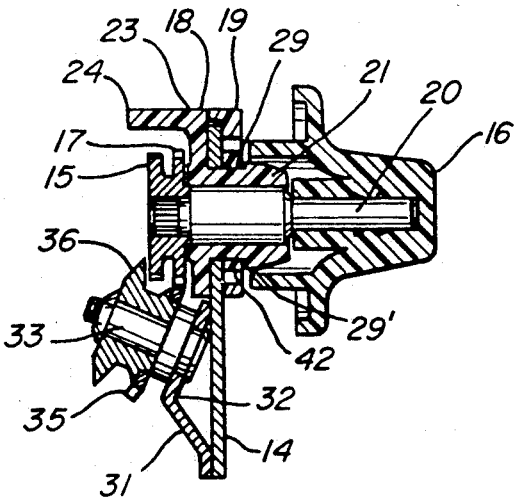
FIG. 4 is a side view of the lower handle shell.
Figure 4:
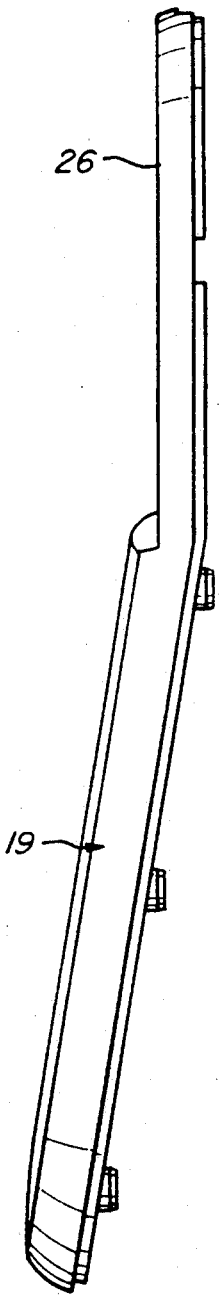
Figure 5:
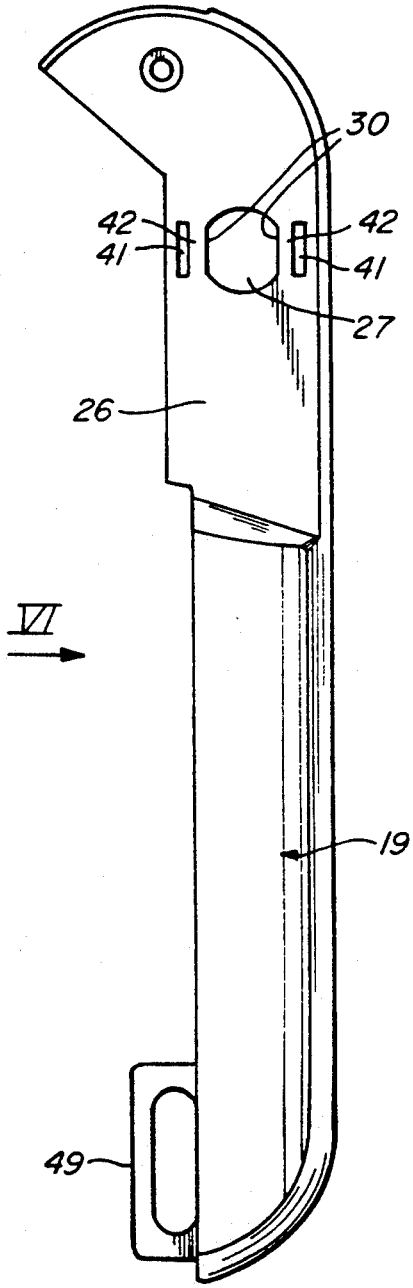
FIG. 5 is a top view of the lower handle shell.
Figure 6:
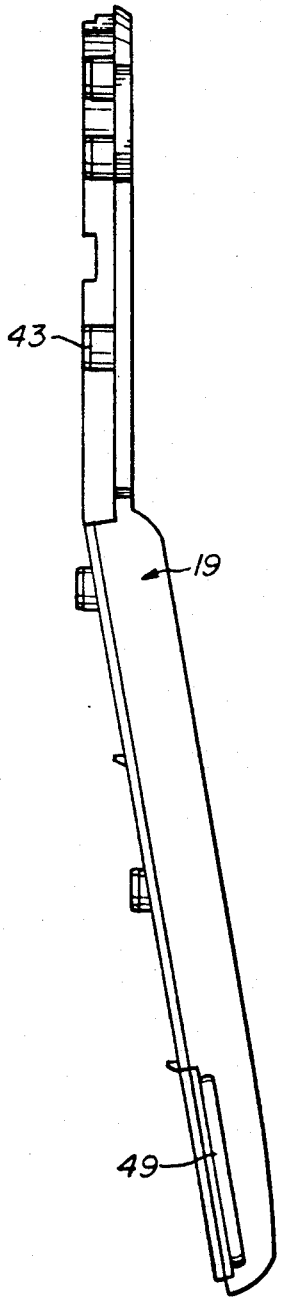
FIG. 6 is a side view of the lower handle shell looking in the direction of the arrow VI in FIG. 5.
Figure 7:
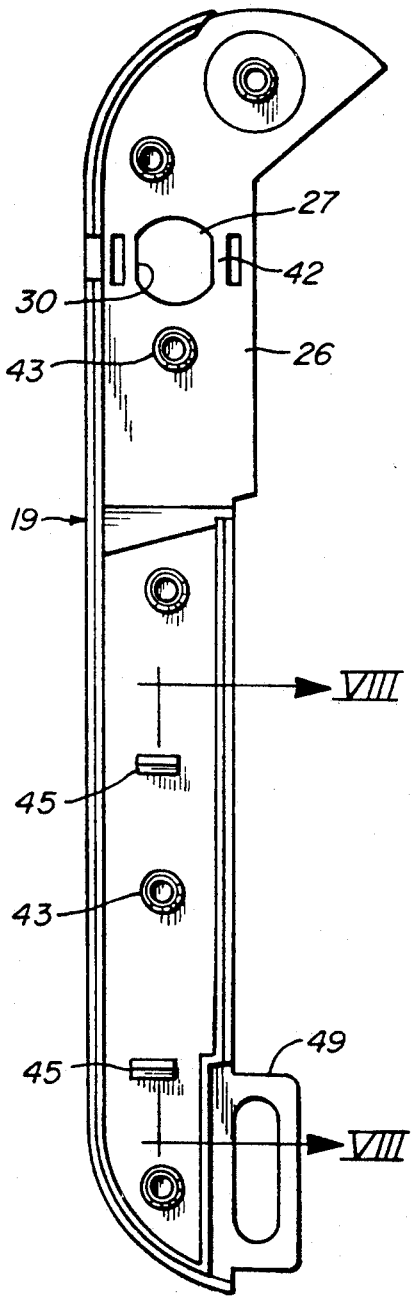
FIG. 7 is a rear view of the lower handle shell that is, a view of FIG. 5, but rotated 180°.

The can opener basically has a first metal lever 11 and a second metal lever 12, see FIG. 3, which are coupled together by a pivot bolt 13. Normally, the pivot bolt is not visible and covered by lever or handle shells, as will appear below. The upper portion of the first lever 11 forms a feed portion or feed arm 14. It carries a feed wheel 15, which is toothed or geared or serrated at the edge, as well known. The feed wheel 15, see FIGS. 3 and 14, can be rotated by a feed knob 16 (FIGS. 2, 3) coupled to the feed gear 15 by a bolt 20. The bolt 20 can be threaded. Bolt 20 is guided in a bearing bushing 21, see FIG. 14. The feed wheel 15 as well as a gear 17 are secured to the bolt 20 to rotate therewith. The knob 16, as is customary, is made of plastic and securely coupled to the bolt 20.

The second lever 12 forms, at the end closest to the pivot, which may also be referred to as the upper end, a cutting lever 31. A generally pyramidal bearing 32 (FIG. 14) retains a rivet bolt 33. A gear 35, to which a cutter wheel 36 is coupled, are rotatable on the bearing bolt 33.

When the lever arms 11, 12 are positioned closely against each other, gears 17 and 35 will be engaged. Thus, an operator can rotate the knob 16, and the rotation is transferred via gears 15, 35 to the cutter wheel 36. When assembled, the handles are rounded at the bottom, to form overall handle units 39, 40.

The handle 39 is formed by an upper handle shell 18 (FIGS. 9 through 13) and a lower handle shell 19 (FIGS. 4 through 8), with the metal portion of the handle, that is, metal levers 11, 12, therebetween.

The handle 40, likewise, is formed of an upper and lower handle shell. The handle shells of the handle 40 are somewhat shorter and extend only to the top of the cutter arm portion 31 of the metallic part 12.

Figure 8:
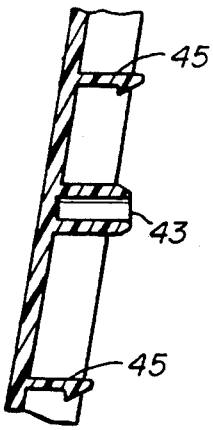
FIG. 8 is a section taken along lines VIII—VIII of FIG. 7.
Figure 9:
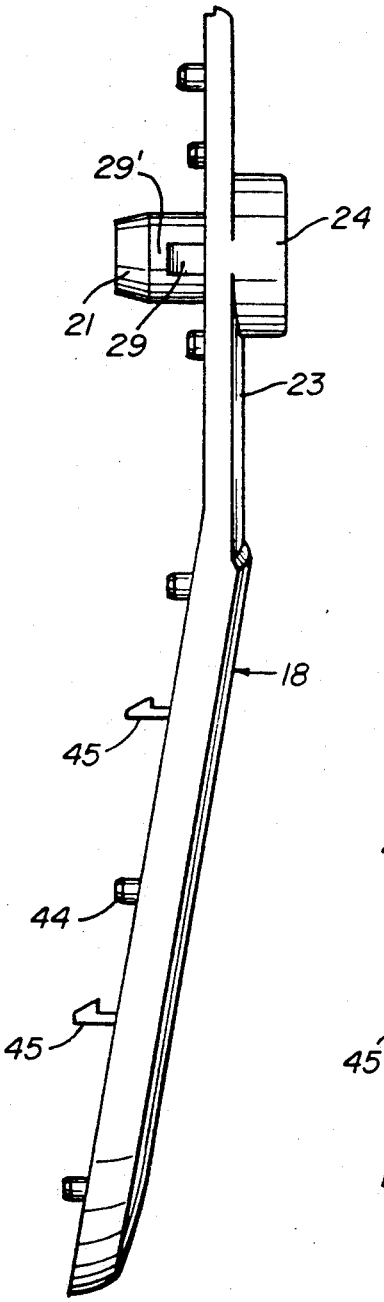
FIG. 9 is a side view of the upper handle shell.

The upper handle shell 18, see FIGS. 8 and 9, is extended towards the pivot point and pivot bolt 20 in disk or plate-like shape.

In accordance with a feature of the invention, the upper handle shell 18 is a unitary, molded element, for example of plastic, which has an engagement or bearing plate 24 (see FIGS. 3 and 14) formed thereon and, interiorly, the bearing bushing 21 molded or formed thereon. The engagement plate, typically a curved plate 24, and the bearing bushing 21, thus, are unitarily connected and coupled to the upper base plate portion 23 (FIGS. 9, 10) of the upper handle shell 18. Thus, the handle shell, bearing bushing and engagement plate can be a single unitary molded plastic element.

The upper handle shell 18 and the lower handle shell 19, with the metal lever 11 therebetween, are coupled together by interengaging projection-and-recess elements. The lower shell 19, similar to the plate 23 on the upper shell, is extended to form a cover portion or cover plate 26. The cover plate 26 is formed with an opening or through-bore 27 in which the bearing bushing 21 fits. The bearing bushing 21 is formed with two flattened surfaces 29 (FIG. 11) at its lower end which fit into and match constrictions 30 (FIGS. 5 , 7) in the opening 27. Two slits 41 are formed in the lower shell 19 to form, between the flattened surfaces 30 of hole 27, and the slits 41, snap-over ribs 42.

Figure 13:
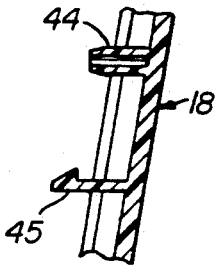
FIG. 13 is a section along line XIII—XIII of FIG. 10.
Figure 10:
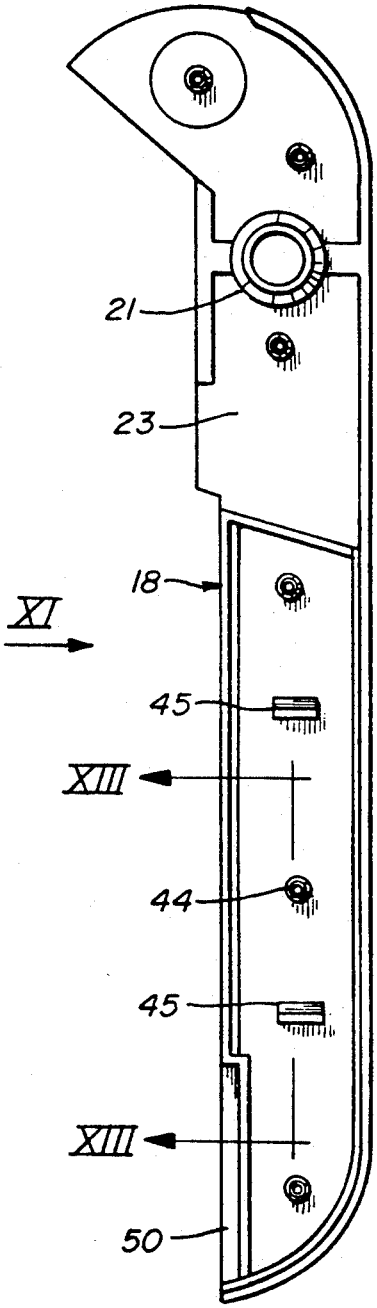
FIG. 10 is a front view of the upper handle shell.
Figure 11:
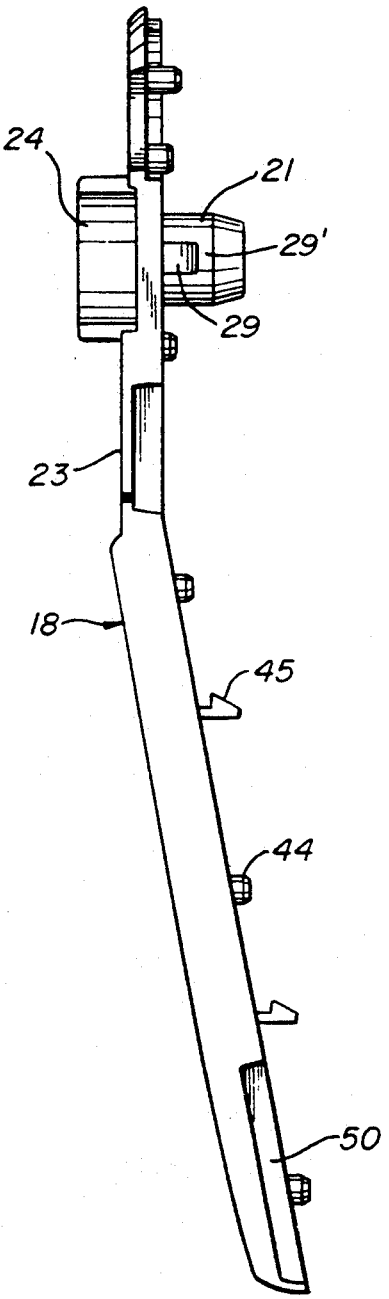
FIG. 11 is a side view of the upper handle shell looking in the direction of the arrow XI of FIG. 10, that is, 180° reversed from FIG. 9.
Figure 12:
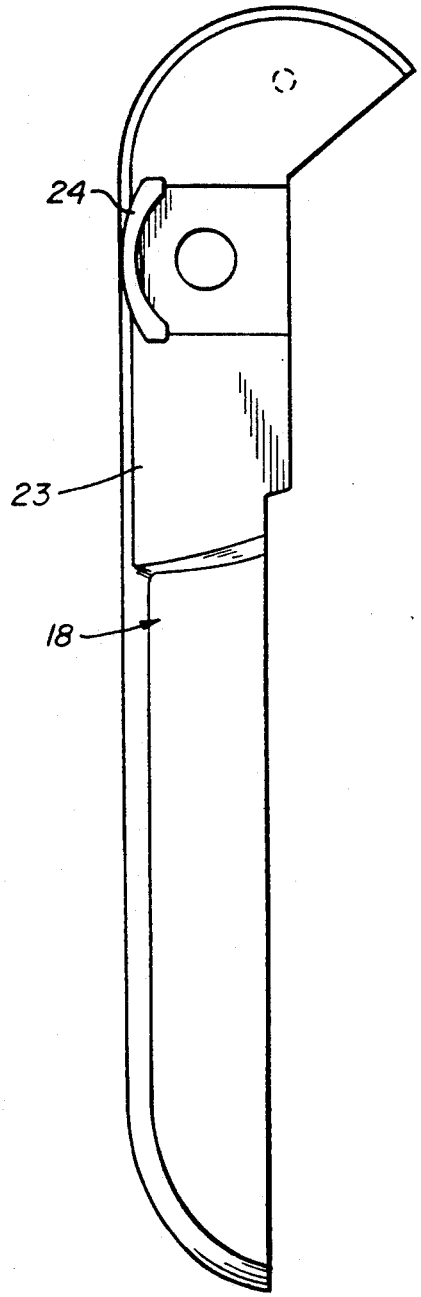
FIG. 12 is a rear view of the upper handle shell, that is, 180° reversed from FIG. 10.

The lower handle shell 19 has projecting bushings or tubular projections 43 which pass through aligned bores 11', 12' (FIG. 3) of the metal levers 11, 12. In FIG. 3, only one of these through-bores is shown for each lever, for simplicity of the drawings. Projecting pins 44 (FIG. 13), extending from the upper shell 18, can be press-fitted in the apertured bushings 43. The pins 44, as seen in FIG. 13, are preferably hollow pins. Further, the upper shell 18 as well as the lower shell 19 have deflectable hooks 45 (FIGS. 8, 13) formed thereon, which engage behind rectangular openings 46 (FIG. 3) of the metal levers 11, 12, respectively.

The handle 40 (FIG. 3) has an upper handle shell 47 and a lower handle shell 48. The upper and lower handle shells 47, 48 are formed, also, with bushings 43, pins 44 and hooks 45, not further shown for simplicity of the drawing. The metal lever 12, likewise, is formed with openings or bores for the bushings 43, as well as with rectangular openings 46 for the hooks 45.

A projecting eye 49, preferably flattened, is formed on the lower shell 19 at the end thereof remove from the pivot 13. The projecting eye 49 can fit into a depression formed on the lower shell 48 of the opposite arm 40; likewise, the upper shell 47 of the arm 40 is formed with an eye-extension 49' which fits into the depression 50 (FIG. 11) of the upper shell 18. The eyes 49, 49' are offset from a central plane passing through the handles so that they overlap, and the can opener can be closed, with both eyes then, for example fitting over a suitable retention hook projecting from a shelf or the like.

Various changes and modifications may be made. The upper shell-bearing bushing engagement or stop plate 24 is preferably made as a unitary plastic injection molding or similarly cast element, although they can be made of other materials as well.

The slits 41 permit resilient deflection of the flattened surfaces 30 (FIG. 5) of the hole 27 in the lower shell 19, when the upper shell 18, with the bearing bushing part 21 thereof, is snapped through the shell 19. The part 21 is preferably formed with a slight enlargement or shoulder beyond the opening 27, as shown at 29', FIG. 14, to provide for secure seating of the bearing bushing 21 and retention of the upper and lower shells 18, 19 in the vicinity of the bearing bushing, and hence also retention of the plates 23, 26 against each other.

We claim:

1. Hand-held squeeze lever or pincer-type can opener having:

first (11) and second (12) metal levers, said levers being pivotably connected at one end;

handle means (39, 40) secured to said levers;

a first one (11) of said levers forming a can feed lever, said can feed lever having:

a feed arm portion (14);

a feed wheel shaft (20);

a feed wheel; (15) and a twist knob (16) coupled to said feed wheel shaft (20) for rotation therewith;

the second (12) of said levers forming a can cutter lever having:

a cutting portion (31);

a rotatable cutter wheel (36) and a cutter wheel shaft retaining said cutter wheel on said cutter portion; and a bearing bushing (21) retaining said feed wheel shaft (20) and said feed wheel (15) thereon;

wherein, in accordance with the invention;

the handle means (39, 40) comprise:

two handle shells (18, 19) formed of a molded plastic material fitted against each other with a respective metal lever (11, 12) therebetween;

one of the handle shells forming an upper handle shell (18) and the other handle shell forming a lower handle shell (19); and interlocking means (43, 44) formed on said handle shells, to retain said handle shells together, with the respective metal handle locked therebetween;

wherein a counter or guide surface means (24) is provided, and said counter or guide surface means (24), said upper bearing bushing (21) and the upper handle shell (18) of the feed arm, together, form a single unitary cast or molded body; and the mating lower handle shell (19) is formed with an opening (27) into which an end portion (28) of the bearing bushing (21) is fitted, said bearing bushing passing through an opening formed in the metal lever of the feed arm portion (14).

2. The can opener of claim 1, wherein the bearing bushing (21) is generally cylindrical and formed with two recessed flattened portions (29);

and wherein the opening (27) formed in the lower handle shell to receive the bearing bushing has a cross-sectional configuration fitting the portion of the bearing bushing with the flattened surfaces.

3. The can opener of claim 2, wherein the lower handle shell (19) is formed with two flattened surfaces projecting into a circular outline of said opening (27);

and slits (41) positioned between said projecting surfaces and end portions of said lower shell, to form snap-in ribs (42) to permit snapping in of the end portion (28) of the bearing bushing into said openings.

4. The can opener of claim 3, wherein said end portion of the bearing bushing is formed with a projecting shoulder (29') fitting over said ribs (42).

5. The can opener of claim 1, wherein said interlocking means comprise hollow bushings (43) projecting from one of said handle shells, and projecting pins (44) fitting within the hollow bushings formed on the other handle shell; and wherein at least one of said handle shells, additionally, is formed with resiliently deflectable hooks(45), and the metal levers (11, 12) are formed with openings into which said resiliently deflectable hooks can engage.

6. The can opener of claim 5, wherein both of said handle shells are formed with said resiliently deflectable hooks (45).

7. The can opener of claim 1, wherein one of said handle shells of each of said handle means is formed, at the end remote from said pivotable connection, with projecting eyes (49, 49') offset from a central plane passing through said metal levers, to form projecting hang-up eyes, and for limiting converging movement of said handle means.

8. The can opener of claim 7, wherein that one of the handle shells opposite a projecting eye (49) is formed with a reception depression (50) for positively locking the respective eye into the depression when the handle means are closed towards each other.

9. The can opener of claim 1, wherein said handle shells comprise, respectively, unitary plastic molded elements.

10. The can opener of claim 1, wherein at least said upper handle shell (18) together with the bearing bushing (21) and the counter or guide surface means (24) comprises a single unitary molded plastic element.

* * * * *